United States Patent [19]

Nieminen

[11] Patent Number: 4,937,943

[45] Date of Patent: Jul. 3, 1990

[54] POWER CHAIN SAW UNIT FOR CUTTING NOTCHES IN A SERIES OF WOODEN ROOF RAFTERS

[76] Inventor: Drew Nieminen, 125 Franklin St., Santa Cruz, Calif. 95060

[21] Appl. No.: 425,011

[22] Filed: Oct. 23, 1989

[51] Int. Cl.[5] ..... B27B 17/00

[52] U.S. Cl. ..... 30/376; 144/133 R

[58] Field of Search ..... 30/166.1, 371, 375–377, 30/381, 383; 144/133 R

[56] References Cited

U.S. PATENT DOCUMENTS

| | | | |
|---|---|---|---|
| 1,170,120 | 1/1916 | Slonaker | 30/381 |
| 1,663,486 | 3/1928 | Wertz | 30/377 |
| 2,925,104 | 2/1960 | Allemann | 143/133 |
| 3,078,885 | 2/1963 | Burch | 30/378 |
| 3,292,673 | 12/1966 | Gregory | 30/377 |
| 3,695,316 | 10/1972 | Pluckhahn | 30/381 |
| 3,799,224 | 3/1974 | Vizziello et al. | 144/133 |
| 3,845,556 | 11/1974 | Edmunson | 30/381 |
| 4,070,757 | 1/1978 | Granberg et al. | 30/371 |
| 4,146,962 | 3/1979 | Grube | 30/381 X |
| 4,244,104 | 1/1981 | Grube | 30/381 X |
| 4,290,464 | 9/1981 | Marsan | 144/136 |

*Primary Examiner*—Douglas D. Watts

*Attorney, Agent, or Firm*—Jack M. Wiseman

[57] ABSTRACT

A guide shoe of a power chain saw unit is movable along a series of side-by-side roof rafters. A power chain saw of the power chain saw unit is connected to the guide shoe by rigid rods. When operated, the power chain saw cuts notches in the roof rafters in the direction of travel of the guide shoe. Fixed to the guide shoe are upstanding plates formed with arcuate slots. The ends of the rigid rods adjacent the upstanding plates are releasably secured along the arcuate slots of the upstanding plates for locking the power chain saw in various selected angular positions relative to the guide shoe for controlling the depth of the notches and the cutting angle of the chain saw blade of the power chain saw.

11 Claims, 2 Drawing Sheets

POWER CHAIN SAW UNIT FOR CUTTING NOTCHES IN A SERIES OF WOODEN ROOF RAFTERS

BACKGROUND OF THE INVENTION

The present invention relates in general to power saws, and more particularly to a power chain saw unit for cutting notches in roof rafters.

In the framing of buildings, notches are formed in the lower end portion of each roof rafter for accommodating the rafter plate. Heretofore, notches in roof rafters were cut individually by hand saws or by electrical circular saws. Subsequently, power saws were employed to cut notches in a series of side-by-side roof rafters. The conventional electrical circular saw was not able to cut at an angle exceeding 45° to meet the seat cut angle requirement. In the past, the seat cut in the notches of roof rafters was difficult to make when cutting notches in a series of roof rafters. Also, as the cutting angle of the electrical circular saw blade was increased in cutting notches in a series of roof rafters, the depth of the seat cut was reduced.

In the cutting of notches in a series of roof rafters, it was heretofore the practice to use a large circular saw with a table. This arrangement was still limited in cutting the depth of the seat cut. Another arrangement heretofore used for the cutting of notches in a series of roof rafters was to use a large circular saw with a series of blades integral with the arbor shaft of the circular saw. The blades rotated and chipped out the seat cut. This arrangement had relatively large torque requirements and a heavy load was imposed on the motor to rotate the blades through solid wood mass.

The Allemann, U.S. Pat. No. 2,925,104, issued on Feb. 16, 1960, for Combination Chain-And-Circular-Saw Portable Power Saw Unit discloses a portable power saw for cutting notches in roof rafters. The portable power saw includes the combination of a circular saw blade and a chain saw blade to cut the notch in the roof rafter.

In the Vizziello et al., U.S. Pat. No. 3,799,224, issued on Mar. 26, 1974, for Rafter Beam Nothing Apparatus, there is disclosed a power driven rotary saw mounted on a pair of rods, which travel horizontally in unison through the superstructure of a frame. The frame includes a table for horizontal placement thereon of a rafter beam to be notched.

In the Burch, U.S. Pat. No. 3,078,885, issued on Feb. 26, 1963, for Portable Power Hand-Guided Saw Mounting Drive, there is disclosed an adapter for a power saw having a disc blade. The disc blade cuts a slit in plywood panels at a predetermined angle relative to the surface of the plywood panel.

The Marsan, U.S. Pat. No. 4,290,464, issued on Sept. 22, 1981, for a Holder For Portable Electric Cutting Instrument, discloses a holder comprising a base plate having a planar bottom surface. An aperture is formed in the base plate through which a cutting tool projects. A rigid harness interconnects angular adjustment means with clamping means for the cutting instrument to provide tilting of the cutting instrument at an angle at least 45°.

The Edmunson, U.S. Pat. No. 3,845,556, issued on Nov. 5, 1974, for Cut Control Attachment For Chain Saws, discloses a sole plate with slots for attachment to a chain saw guide bar. An angle-adjustable guide bar yoke bracket is adjustably carried by the sole plate for adjusting the cutting angle of the chain saw.

In the Granberg et al., U.S. Pat. No. 4,070,757, issued on Jan. 31, 1978, for Log Sawing Attachment For A Chain Saw, there is disclosed a movable guide frame which can be clamped to the cutter bar of the chain saw. The frame guides the chain saw to make cuts of a pre-selected depth.

In the Slonaker, U.S. Pat. No. 1,170,120, issued on Feb. 1, 1916, for Portable Chain Mortising Machine, there is disclosed a device having a plate secured to wood to be bored. The plate is held from displacement by tines.

SUMMARY OF THE INVENTION

An object of the present invention is to provide a portable power chain saw unit for cutting notches in a series of roof rafters that forms a full seat cut for accommodating wall top plates.

Another object of the present invention is to provide a portable power chain saw unit for cutting notches in a series of roof rafters wherein the cutting blade is adjustable for cutting seat cuts having a slope angle of at least 45°.

Another object of the present invention is to provide a portable chain saw unit for cutting notches in a series of roof rafters in which the adjustment of the cutting depth of the cut seat is made with facility and ease of operation.

Another object of the present invention is to provide a power chain saw unit for cutting notches in a series of roof rafters that is adjustable for cutting notches over a wide range of depth for the seat cut and over a wide angular range for the seat pitch.

Another object of the present invention is to provide a power chain saw unit for cutting notches in a series of roof rafters which has an improved power to weight ratio.

The power chain saw unit of the present invention comprises a guide shoe movable along a series of roof rafters in a direction to cut notches in the roof rafters. A power chain saw is adjustably secured to the guide shoe for setting the angle of a chain saw blade assembly relative to the surface of the rafters to cut notches in the rafters of a predetermined depth and at a predetermined angle. Upstanding plates secured to the guide shoe are formed with arcuate slots. Interconnecting the power chain saw and the upstanding plates are rigid rods. Means at the ends of the rods, respectively, are received by the arcuate slots, respectively, for adjustably securing the power chain saw at an adjustable angle relative to the guide shoe.

A feature of the present invention is an arrangement for stabilizing the chain saw blade assembly by attachment means attached to the track of the chain saw blade assembly and releasably secured to the upstanding plates of the guide shoe. The attachment means are loosened during the adjustment of the angle of the power chain saw relative to the guide shoe and are tightened after the angle of the power chain saw relative to the guide shoe is set.

DETAILED DESCRIPTION OF THE PREFERRED EMBODIMENT

Figure 1:
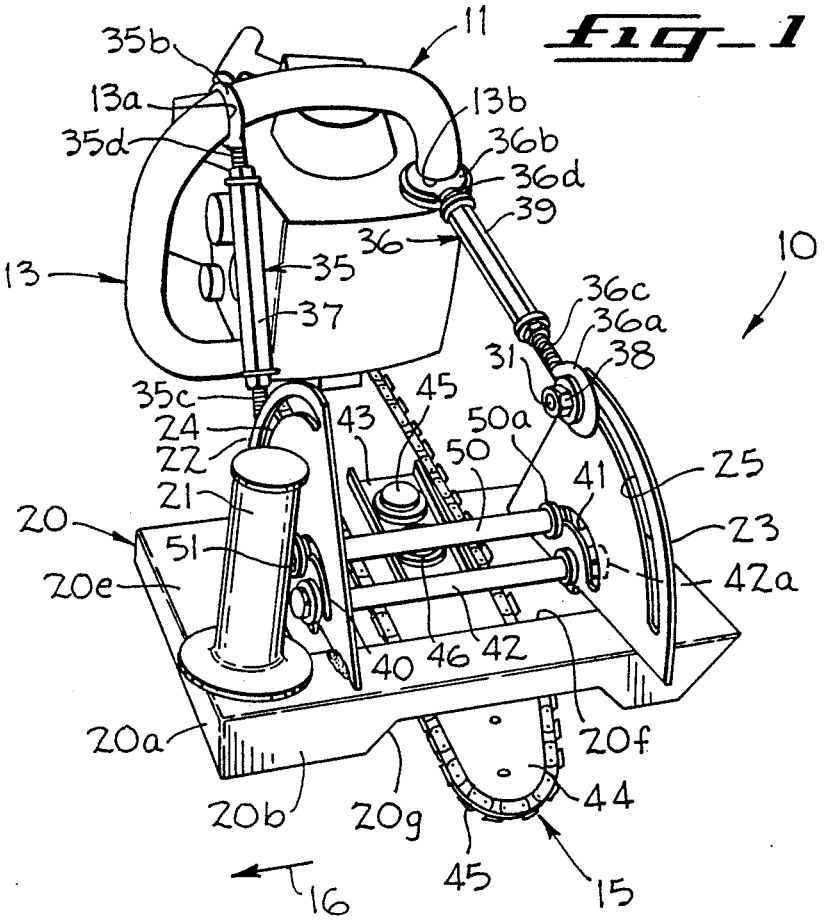
FIG. 1 is a perspective view of the power chain saw unit embodying the present invention.

Illustrated in FIGS. 1–4 is a portable power chain saw unit 10 embodying the present invention. The power chain saw unit 10 is employed for cutting notches N (FIGS. 2 and 4) in a series of roof rafters R. The notches N accommodate rafter plates in the construction of a wooden frame for a building.

The portable power chain saw unit 10 (FIG. 1) comprises a conventional portable power chain saw 11 having a suitable drive motor 12c within a housing 12. Fixedly secured to the housing 12 is a U-shaped handle 13. The drive motor 12c, in a well-known manner, drives a conventional chain saw blade assembly 15. The drive motor 12c, the housing 12, and the chain saw blade assembly 15 are well-known in the art. In the exemplary embodiment, an ECHO power saw of the gasoline engine type is employed, which is manufactured and sold by Kloritz Corp. of Japan, Model CS-302S.

Figure 2:
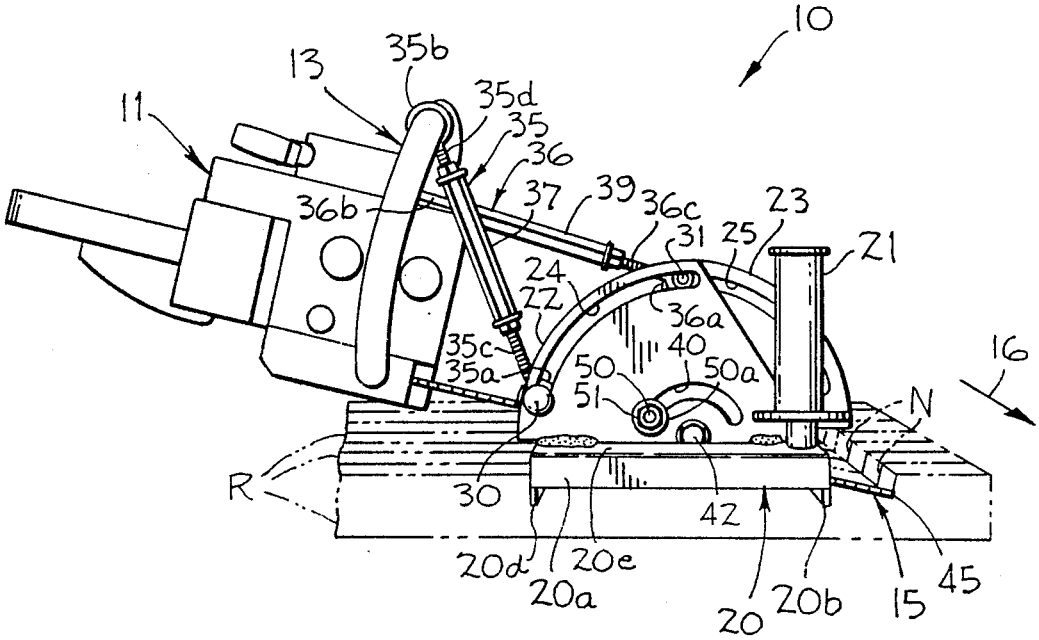
FIG. 2 is a right side elevation view of the power chain saw unit shown in FIG. 1 illustrating the cutting of notches in a series of roof rafters.

Disposed forwardly of the housing 12 in the direction of the projection of the chain saw blade assembly 15 is a guide shoe or sole plate 20 that is movable by an operator transversely across a series of side-by-side roof rafters R for the cutting of notches N in the roof rafters R as shown by an arrow 16 in FIGS. 1 and 2.

Figure 3:
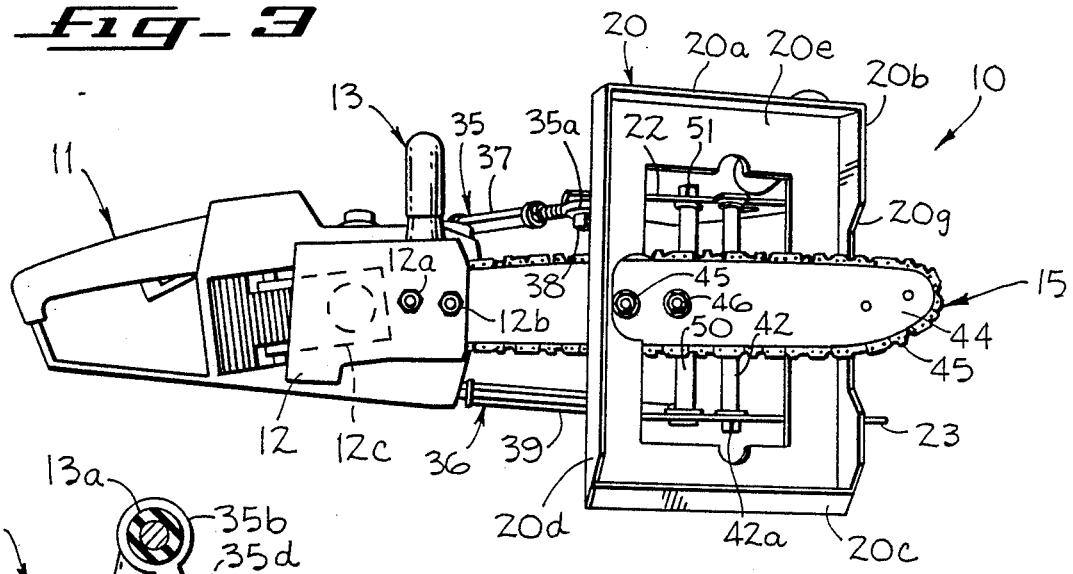
FIG. 3 is a bottom view of the power chain saw unit shown in FIGS. 1 and 2.

The guide shoe 20 comprises depending flanges 20a–20d and a top plate 20e (FIGS. 1 and 3). The runner flanges 20b and 20d (FIG. 2) engage the upper surfaces of the roof rafter R during the transverse movement of the guide shoe 20 in the direction of the arrow 16 (FIGS. 1–3). The top plate 20e is formed with a suitable opening 20f to receive the forward end of the chain saw blade assembly 15. A suitable opening 20g is formed in the flange 20b so that the cutting section and the forwardmost end of the chain saw blade assembly 15 extends forwardly of the guide shoe 20. At one corner of the shoe 20 is an upright handle 21 that is fixedly secured to the top plate 20e.

Fixedly secured to the top plate 20e of the guide shoe 20 are upstanding plates 22 and 23 (FIGS. 1, 2 and 4), which are formed with arcuate slots 24 and 25, respectively. The chain saw blade assembly 15 is disposed below the upstanding plates 22 and 23 and is disposed intermediate planes passing through the upstanding plates 22 and 23. The upstanding plates 22 and 23 are spaced apart in the direction of travel of the shoe 20 as shown by the arrow 16 in FIG. 1. Received by the slots 24 and 25, respectively, are suitable bolts 30 and 31. The bolts 30 and 31, respectively, are freely received by annular ends 35a and 36a of rigid rods 35 and 36, respectively.

Nuts, such as nut 38, are removably secured to the bolts 30 and 31, respectively, for releasably securing the annular ends 35a and 36a of the rods 35 and 36 to the upstanding plates 22 and 23, respectively, for adjustably positioning the annular ends 35a and 36a of the rods 35 and 36, respectively, along the slots 24 and 25, respectively. Angle and/or depth indicia may be marked on the upstanding plates 22 and 23 in the vicinity of the slots 24 and 25. At the ends of the rods 35 and 36 opposite from the annular ends 35a and 36a are annular ends 35b and 36b, respectively, which freely receive the U-shaped handle 13. The annular ends 35b and 36b of the rods 35 and 36, respectively, are at a fixed location along the U-shaped handle 13, but are rotatable to accommodate the movement of the rigid rods 35 and 36 during the adjustable movement of the annular ends 35a and 36a along the slots 24 and 25, respectively. Toward this end, recesses 13a and 13b are formed in the handle 13 to locate the annular ends 35b and 36b at a predetermined position along the handle 13, and, yet, permit free rotation of the annular ends 35b and 36b relative to the handle 13 when the angle of the housing 12 is adjusted relative to the guide shoe 20.

In the exemplary embodiment, the rigid rods 35 and 36 are threaded. Each rigid rod 35 and 36 has threaded separable stems surrounded by a threaded sleeve to enable an initial adjustment of the effective length of the rigid rods 35 and 36, respectively. The rigid rod 35 comprises threaded stems 35c and 35d and the threaded sleeve 37. The rigid rod 36 comprises threaded stems 36c and 36d and the threaded sleeve 39.

By releasably securing the annular ends 35a and 36a along the arcuate slots 24 and 25, respectively, of the upstanding plates 22 and 23, respectively, through the nuts and bolts 30, 31, and 38, the angle of the housing 12 relative to the upper surfaces of the roof rafters R is adjusted. The adjustable positioning of the annular ends 35a and 36a causes the rigid rods 35 and 36 to adjustably position the housing 12 at a selected angle relative to the guide shoe 20. As a consequence thereof, the cutting section of the chain saw blade assembly 15 is commensurately adjusted to regulate the cutting depth of the cut seat of the notches N and the angle of the wall cut in the roof rafters R to form the notches N. The angular movement of the housing 12 causes a commensurate angular movement of the chain saw blade assembly 15 in unison with the housing 12 in a well-known and conventional manner, such as nuts and bolts 12a and 12b being secured to a generally oval track 44 of the chain saw blade assembly 15 and the housing 12 (FIG. 3). The drive assembly including the drive motor 12c is secured to the housing 12 for movement therewith in a well-known and conventional manner.

Figure 4:
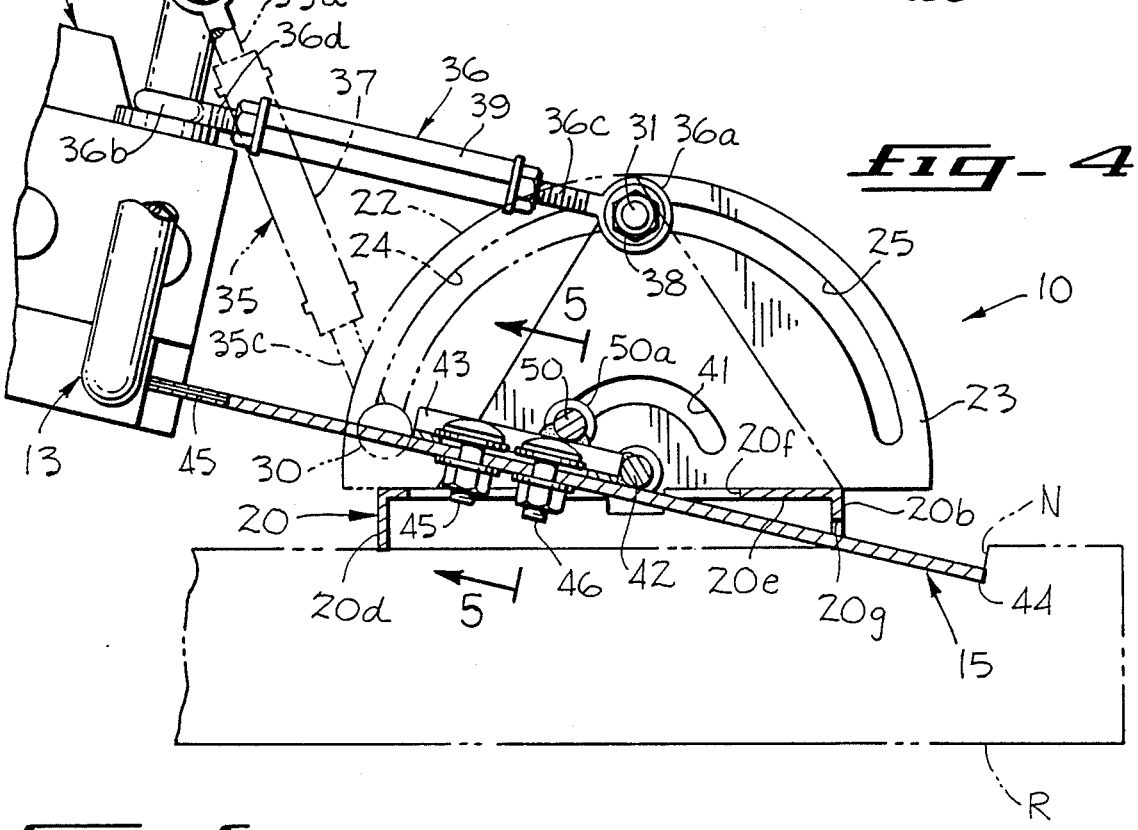
FIG. 4 is a fragmentary, diagrammatic left side elevation view of the power chain saw unit shown in FIGS. 1–3 shown partially in section and partially in phantom lines and partially broken away illustrating the cutting of a notch in a roof rafter and a stabilizing assembly for stabilizing the chain saw blade assembly during the cutting opeation.
Figure 5:
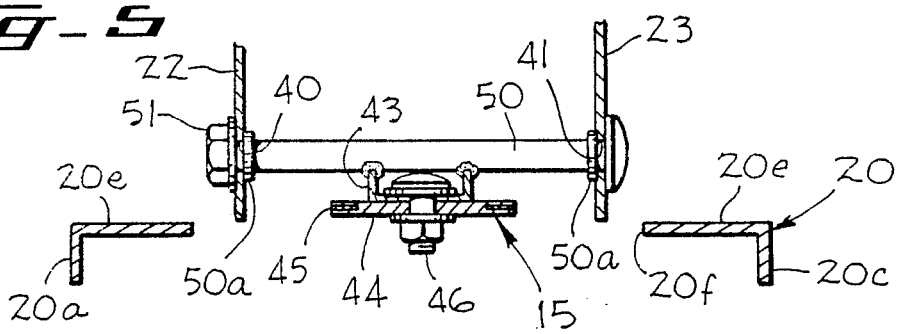
FIG. 5 is a fragmentary vertical section taken along line 5—5 of FIG. 4 to illustrate the stabilizing assembly for stabilizing the chain saw blade assembly during the cutting operation.

In the preferred embodiment, the chain saw blade assembly 15 is stabilized during the cutting operation (FIGS. 1, 4 and 5). For stabilizing the chain saw blade assembly 15 during the cutting operation, arcuate slots 40 and 41 are formed in the upstanding plates 22 and 23, respectively, below the slots 24 and 25, respectively. Extending between the upstanding plates 22 and 23 below the slots 24 and 25 and the upstanding plates 22 and 23 is a rod 42. In the exemplary embodiment, the rod 42 is in the form of a nut and bolt and the bolt is received by a sleeve. The rod 42 is releasably secured to the upstanding plates 22 and 23. Fixedly secured to the rod 42 at right angle to the axis thereof is a channel-shaped support plate 43. The channel-shaped support plate 43 is releasably secured to the generally oval track 44 of the chain saw blade assembly 15 about which the endless chain of linked cutting teeth 45 is trained for rotation. Nuts and bolts 45 and 46 secure the bottom wall of the channel-shaped support plate 43 to the oval track 44 of the chain saw blade assembly 15. The rod 42 is fixed to the free upper edges of the flanges of the channel-shaped support plate 43. Also secured to the free upper edges of the channel-shaped support plate 43 is a bolt 50 having a sleeve 50*a*. Opposite ends of the bolt 50 are received by the slots 40 and 41, respectively. A nut 51 at one end of the bolt 50 releasably secures the bolt 50 to the upstanding plates 22 and 23.

When the angle of the housing 12 is adjusted for regulating the cutting depth of the seat cut of the notch N and the angle of the wall defining the seat cut of the notch N, the nut 51 is loosened to enable the bolt 50 to move freely within the slots 40 and 41, and a nut 42*a* is loosened to enable pivotal movement of the channel-shaped support plate 43 about the axis of the rod 42. After the angle of the housing 12 is adjusted and the rigid rods 35 and 36 are releasably secured to the upstanding plates 22 and 23, the nut 51 is tightened to releasably secure the bolt 50 to the upstanding plates 22 and 23 and the nut 42*a* is tightened to releasably secure the rod 42 to the upstanding plates 22 and 23.

In the use of the power chain saw unit 10, the operator adjusts the angle of the housing 12 relative to the guide shoe 20 for selecting the desired cutting depth for the notches to be formed and for selecting the cutting angle of the chain saw blade assembly 15 relative to the upper surface of the roof rafters R. Toward this end, the nuts, such as nut 38, are loosened and the nuts 51 and 42*a* are loosened. Thereupon, the bolts 30 and 31 are moved to a desired location along the slots 24 and 25. This action adjusts the angle of the housing 12 relative to the guide shoe 20 for cutting the desired cutting depth for the notches to be formed and for cutting the wall of the notches at a desired angle relative to the upper surfaces of the roof rafters R. Now, the nuts, such as nut 38, are tightened and the nuts 51 and 42*a* are tightened to retain the housing 12 at the adjusted angle relative to the guide shoe 20. When the angle of the housing 12 is adjusted for regulating the cutting depth of the seat cut of the notch N and the angle of the wall defining the seat cut of the notch N, the nut 51 is loosened to enable the bolt 50 to move freely within the slots 40 and 41, and a nut 42*a* is loosened to enable pivotal movement of the channel-shaped support plate 43 about the axis of the rod 42. After the angle of the housing 12 is adjusted and the rigid rods 35 and 36 are releasably secured to the upstanding plates 22 and 23, the nut 51 is tightened to releasably secure the bolt 50 to the upstanding plates 22 and 23 and the nut 42*a* is tightened to releasably secure the rod 42 to the upstanding plates 22 and 23.

An operator starts the motor 12*c* for operating the chain saw blade assembly 15. The handles 13 and 21 are gripped by the operator. The operator places the guide shoe 20 on the upper surface of the roof rafters R at the location to cut the notches in a series of side-by-side roof rafters R. The roof rafters R support the guide shoe 20 and, in turn, the power chain saw 11 is supported by the guide shoe 20. As the power chain saw 11 is guided across the roof rafters R in the direction of the arrow 16 (FIGS. 1 and 2) in alignment with a guide line, not shown, the chain saw assembly 15 cuts one wall of each of the roof rafters R in a series of roof rafters R.

After the one wall of each of the roof rafters R is cut, the operator moves the power saw unit 10 to the opposite side of the notch to be formed. The above procedure is repeated for the chain saw assembly 15 to cut the other wall of each of the roof rafters R in the series of roof rafters R to form the notches N in the roof rafters R.

What is claimed is:

1. A portable power chain saw unit comprising:

(a) a guide shoe adapted to engage the upper surface of a workpiece for movement therealong, said guide shoe being formed with an opening;

(b) a power chain saw having a chain saw blade assembly extending through said opening in said guide shoe and projecting beyond said guide shoe for cutting the workpiece;

(c) a plurality of spaced apart upstanding plates secured to said guide shoe, said upstanding plates being spaced apart in the direction of movement of said guide shoe; and (d) a plurality of rigid rods interconnecting said power chain saw and said upstanding plates respectively, said rigid rods being releasably secured to said upstanding plates respectively for locking said power chain saw in various selected angular positions relative to said guide shoe for controlling the depth and the angle of the cut in said workpiece.

2. A portable power chain saw unit as claimed in claim 1 wherein each of said upstanding plates is formed with an arcuate slot extending generally in the direction in which said chain saw blade assembly extends, and wherein each of said rigid rods includes connecting means at one end thereof movable along the arcuate slot of its associated upstanding plate and being releasably secured to its associated upstanding plate for locking said power chain saw in the selected angular position relative to said guide shoe.

3. A portable power chain saw unit as claimed in claim 2 wherein said power chain saw includes a generally U-shaped handle extending in the direction of movement of said guide shoe, and wherein each of said rigid rods includes connecting means at the other ends thereof freely receiving said U-shaped handle for rotation thereabout, said connecting means at said other end of said rigid rods being seated within respective recesses formed in said handle for retaining said connecting means at said other end of said rigid rods in a fixed spaced relationship.

4. A portable power chain saw unit as claimed in claim 3 wherein said power chain saw comprises a housing and a motor disposed in said housing for driving said chain saw blade assembly, said power chain saw being constructed and arranged so that angular movement of said housing relative to said guide shoe imparts a corresponding angular movement to said motor and said chain saw blade assembly relative to said guide shoe, said U-shaped handle being fixed to said housing, whereby moving said connecting means at the one end of each of said rigid rods respectively along the arcuate slot of its associated upstanding plate and releasably securing said connecting means at said one end of each of said rigid rods to its associated upstanding plate, respectively, locks said housing, said motor and said chain saw blade assembly in a selected angular position relative to said guide shoe.

5. A portable chain saw unit as claimed in claim 2 and further comprising stabilizing means interconnecting said chain saw blade assembly and said guide shoe for stabilizing said chain saw blade assembly.

6. A portable power chain saw unit as claimed in claim 5 wherein each of said upstanding plates includes a second arcuate slot disposed below its associated first mentioned arcuate slot and extending in the same general direction as its first mentioned arcuate slot, and wherein said chain saw blade assembly includes a generally oval track and an endless chain of cutting teeth trained about said oval track for rotation, said stabilizing means comprising:

a stabilizing rod extending between said upstanding plates and received by said second arcuate slots for movement therealong, said stabilizing rod including means for releasably securing said stabilizing rod to said upstanding plates, said means for releasably securing said stabilizing rod to said upstanding plates being loosened to permit movement of said stabilizing rod within said second slots prior to the positioning of said power chain saw to a selected angular position relative to said guide shoe and being tightened for locking said stabilizing rod to said upstanding plates after said power chain saw is angularly positioned relative to said guide shoe; and means interconnecting said stabilizing rod to said oval track.

7. A portable power chain saw unit as claimed in claim 6 wherein said stabilizing means further comprises a second stabilizing rod extending between said upstanding plates, means on said second stabilizing rod releasably securing said second stabilizing rod to said upstanding plates, said second stabilizing rod being secured to said means interconnecting the first mentioned stabilizing rod to said oval track, said means for releasably securing said second stabilizing rod to said upstanding plates being loosened to enable said chain saw assembly to pivot about said second stabilizing rod prior to the positioning of said power chain saw to a selected angular position relative to said guide shoe and being tightened for locking said second stabilizing rod to said upstanding plates after said power chain saw is angularly positioned relative to said guide shoe.

8. A portable power chain saw unit as claimed in claim 7 wherein said means interconnecting said first mentioned stabilizing rod to said oval track is a channel-shaped plate having a lower wall secured to said oval track and having a plurality of upwardly directed flanges spaced apart in the direction of movement of said guide shoe, said first mentioned stabilizing rod and said second stabilizing rod being secured to said flanges of said channel-shaped plate at the free ends of said upwardly directed flanges.

9. A portable power chain saw unit as claimed in claim 3 and comprising a second handle secured to said guide shoe.

10. A portable power chain saw unit as claimed in claim 4 and comprising a second handle secured to said guide shoe.

11. A portable power chain saw unit as claimed in claim 1 wherein each of said rigid rods comprises means for adjusting the effective length thereof.

* * * * *